United States Patent [19]

Scherer

[11] Patent Number: 5,040,498

[45] Date of Patent: Aug. 20, 1991

[54] VALVE ARRANGEMENT FOR CYLINDERS OF AN INTERNAL COMBUSTION ENGINE

[76] Inventor: Peter Scherer, Am Zigeunerbergl 1, 8104 Grainau, Fed. Rep. of Germany

[21] Appl. No.: 448,925

[22] Filed: Dec. 12, 1989

[51] Int. Cl.[5] ..... F01L 7/00

[52] U.S. Cl. ..... 123/81 D

[58] Field of Search ..... 123/188 B, 81 D, 188 C

[56] References Cited

U.S. PATENT DOCUMENTS

| | | | |
|---|---|---|---|
| 1,273,002 | 7/1918 | Samuels | 123/81 D |
| 1,537,248 | 5/1925 | Maloney | 123/188 B |
| 1,818,527 | 8/1931 | Becker | 123/188 B |
| 2,409,350 | 10/1946 | Forrest | 123/188 B |
| 4,765,287 | 8/1988 | Taylor et al. | 123/81 D |

FOREIGN PATENT DOCUMENTS

| | | |
|---|---|---|
| 371496 | 3/1923 | Fed. Rep. of Germany . |
| 246287 | 1/1926 | United Kingdom . |

*Primary Examiner*—E. Rollins Cross

*Assistant Examiner*—Erick Solis

*Attorney, Agent, or Firm*—Juettner Pyle & Lloyd

[57] ABSTRACT

In known valve arrangements with flat slide valves the inlet valve and outlet valve of a cylinder are formed by a single flat slide which includes two small, sickle-shaped slots which are alternately brought to coincidence with the inlet port and the outlet port of the cylinder. The small, sickle-shaped slots make it more difficult to fill in the fuel mixture and to exhaust the combustion gases. According to the invention, a separate flat slide is respectively arranged as an inlet valve and an outlet valve of a cylinder, the slide having a closed flat slide surface and being movable between a retracted opening position and an extended closing position. The total surface of the inlet port and the outlet port can thereby be increased to 60 to 90% of the inner cross-sectional area of the cylinder, whereby an optimum cylinder filling and removal of the combustion gases are made possible. The opening lift of the flat slide valve of the inlet port is variable.

8 Claims, 7 Drawing Sheets

VALVE ARRANGEMENT FOR CYLINDERS OF AN INTERNAL COMBUSTION ENGINE

Figure 1:
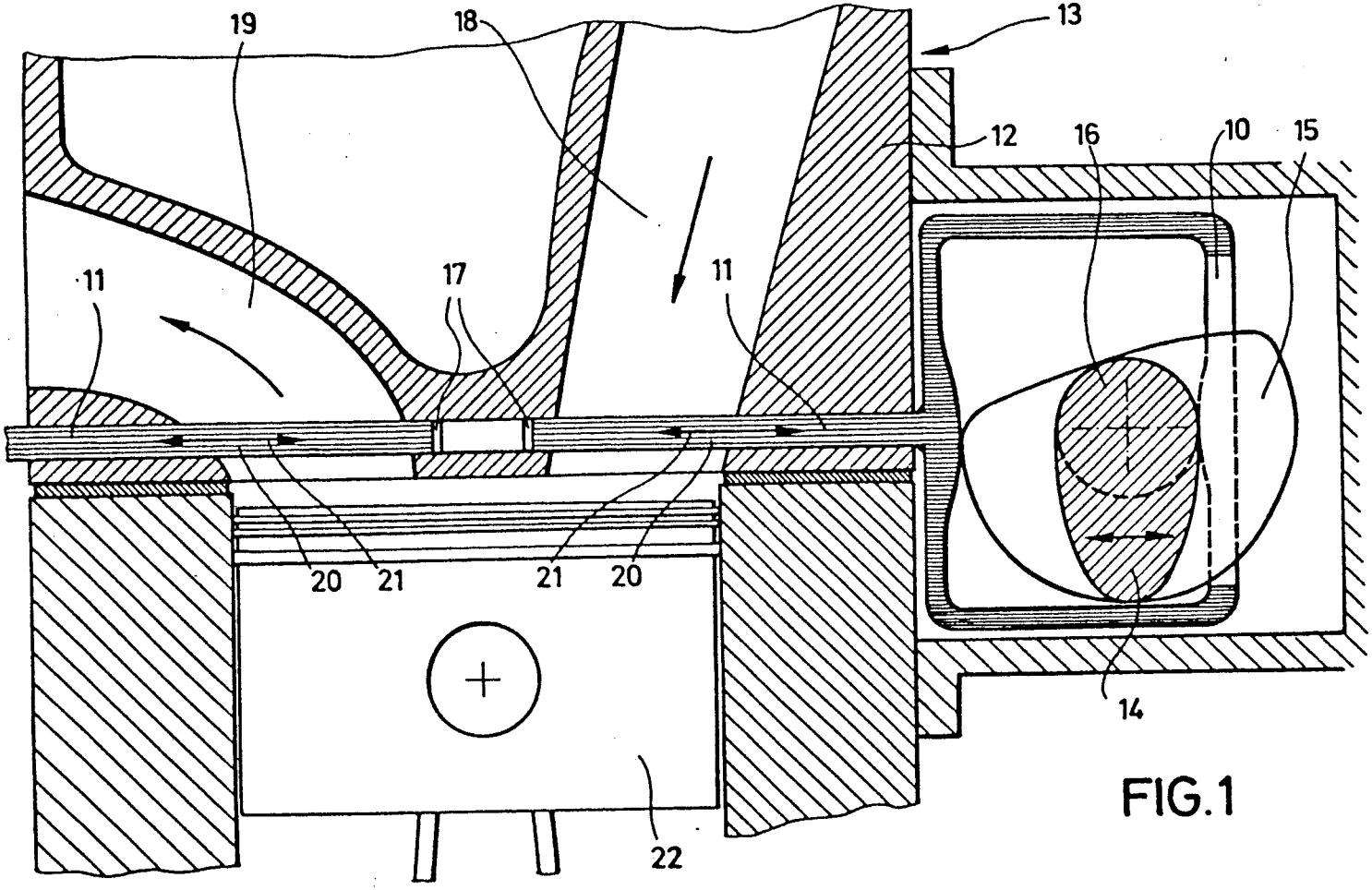

This invention relates to a valve arrangement for cylinders of an internal combustion engine, with the valves being formed as flat slides having a closed wall surface, i.e. without slots or other penetrations, or as rotary valves.

GB 246,287, U.S. Pat. No. 1,273,002 and DE 371,496 already disclose valve arrangements which are intended for internal combustion engines and whose inlet and outlet valves are formed by flat slides reciprocated by a camshaft or crankshaft into the opening or closing position. All known valve arrangements have the common feature that the inlet valve and the outlet valve of a cylinder are formed by a single flat slide which includes two small, sickle-shaped slots whose distance from each other is greater than the mutual distance of the cylinder inlet and outlet ports which are also sickle-shaped, the slide being reciprocated such that the one sickle-shaped slot of the flat slide is alternately brought to coincidence with the inlet port, and the other sickle-shaped slot with the outlet port of the cylinder.

These known flat slides have the disadvantage that their small, sickle-shaped slots make it more difficult to fill in the combustion mixture and to exhaust the combustion gases, whereby the engine performance is impaired.

It is the object of the present invention to improve a valve arrangement of the type in question in such a way that the shortcomings of the prior art are avoided. It is also the object of this invention to provide a valve arrangement with the aid of which an optimum cylinder filling can be accomplished.

According to a first aspect of the invention, this object is attained in that a separate flat slide is respectively arranged as an inlet valve and an outlet valve of a cylinder, each flat slide comprising a closed flat slide surface without through holes, such as slots, and being movable between a rectraced opening position and an extended closing position and guided in a gastight way in recesses of the valve head, and that the total surface of the inlet port and the outlet port amounts to 60 to 90% of the inner cross-sectional surface of the cylinder.

Such flat slides as valve elements have the advantage that the inlet port and the outlet port of the cylinder can have a considerable size so that the arrangement of several inlet valves and outlet valves, as can be found in the prior art, is no longer necessary for achieving a great opening surface.

An electromagnetic or hydraulic control of the flat slides, which is also within the scope of the invention, allows variable opening and closing times together with a microprocessor or through the CO measurement at the exhaust by means of the lambda probe so that a optimum performance can respectively be achieved.

According to another proposal of the invention the inlet port and the outlet port can have a substantially semicircular shape, with the semicircles being separated from each other by a center web. The total surface of the inlet port and the outlet port amounts to 60 to 90% of the cross-sectional surface of the cylinder, whereby an optimum cylinder filling, as well as an optimum removal of the combustion gases are made possible.

The flat slides can be movable in a direction substantially perpendicular to the direction of movement of the piston, with two lateral camshafts being then provided for the actuation thereof. Each flat slide can be connected at its end projecting laterally from the cylinder head, to an annular actuation lever which encompasses an opening cam and preferably two closing cams of the camshaft.

Since a maximum cylinder filling is not necessary or desired in the lower speed range of the engine, the inlet port should here not be opened entirely. It is suggested in the invention for this purpose that the distance between the camshaft assigned to the inlet ports and the inlet ports of the cylinder should be made variable by arranging the camshaft in a laterally displaceable way by means of a suitable adjusting mechanism so that the opening degree of the inlet ports can be controlled accordingly. This can be achieved by reducing the distance of the camshaft from the inlet ports in the lower speed range so that the inlet port is only partly exposed in the retracted opening position of the flat slide.

According to an alternative proposal of the invention, rocker arms including annular actuation portions that encompass the associated opening and closing cams of the camshaft can extend through the respective end portion of the flat slides of the inlet ports and can be pivotably supported about adjustable axes, whereby with a constant position of the camshaft the opening and closing lifts of the slides are infinitely variable, the respective postion of the rocker axis being adjustable through a suitable mechanism, e.g. hydraulically, mechanically or by means of an electric motor, in conjunction with a microprocessor and preferably a lambda probe.

In an alternative embodiment of the invention the slides can be arranged in a direction oblique to the direction of movement of the piston, a single upper camshaft being then adequate for the actuation of the two flat slides, or they may extend parallel to the direction of movement of the piston.

According to another aspect of the invention, a rotary valve which may preferably comprise two valve disks that are rotatable independently of each other can be arranged as the inlet and outlet valves of a cylinder. The valve disks can be rotatable about a central axis which is in alignment with the longitudinal center axis of the cylinder, with suitable drive means being provided for the cyclic rotation of the individual valve disks by 180° in each case. With this embodiment of the invention the inlet port and the outlet port can also have a substantially semicircular shape and such a great cross-sectional surface, preferably 60 to 90% of the inner cylinder surface, that optimum cylinder fillings and an optimum removal of the combustion gases are ensured. It goes without saying that in this embodiment, like in the other embodiments of the invention, suitable seals must be provided for the gastight sealing of the inlet and outlet ports.

As is generally known, two, or sometimes even more than two, inlet and outlet valves are provided on a cylinder in conventional engines to achieve a sufficiently great total inlet port and total outlet port. The arrangement of several inlet or outlet valves can be avoided through the invention by the use of flat slides or rotary valves as the opening cross-sections of the inlet port and the outlet port can thereby be increased considerably, resulting in a considerable increase in engine performance.

According to another proposal of the invention, the arrangement of several inlet and outlet valves can be avoided by using a valve with a valve disk which is oval in plan view, instead of a conventional valve including a closing disk which is circular in plan view and reciprocated in the direction of the valve stem so as to open or close the associated cylinder port. The correspondingly oval inlet port or outlet port of the cylinder head can thus occupy a considerable part of the available cross-sectional area of the cylinder so that according to this proposal of the invention the arrangement of two or more inlet valves and outlet valves per cylinder can be avoided at the same or an even greater opening cross-section.

Figure 2:
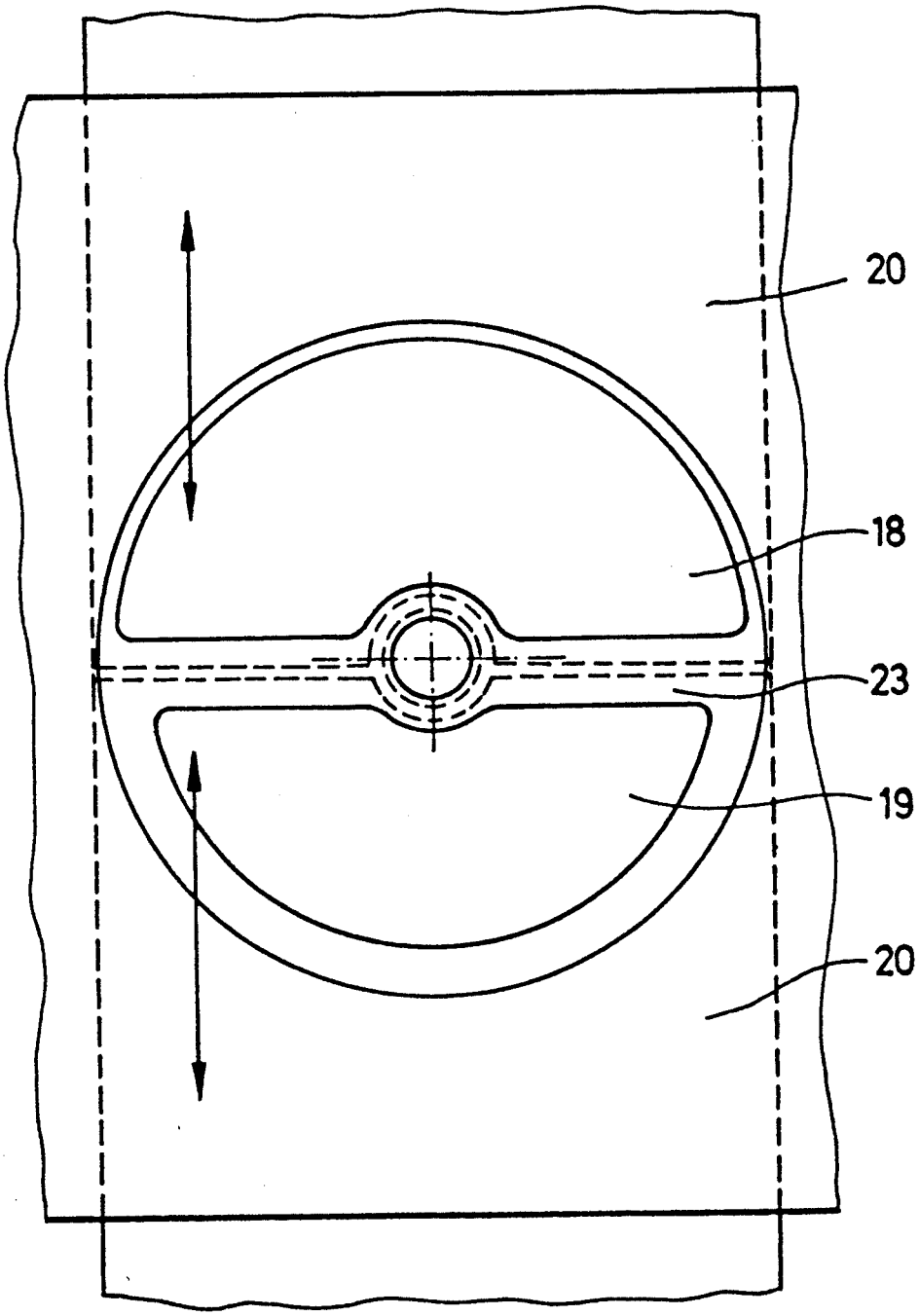
Figure 3:
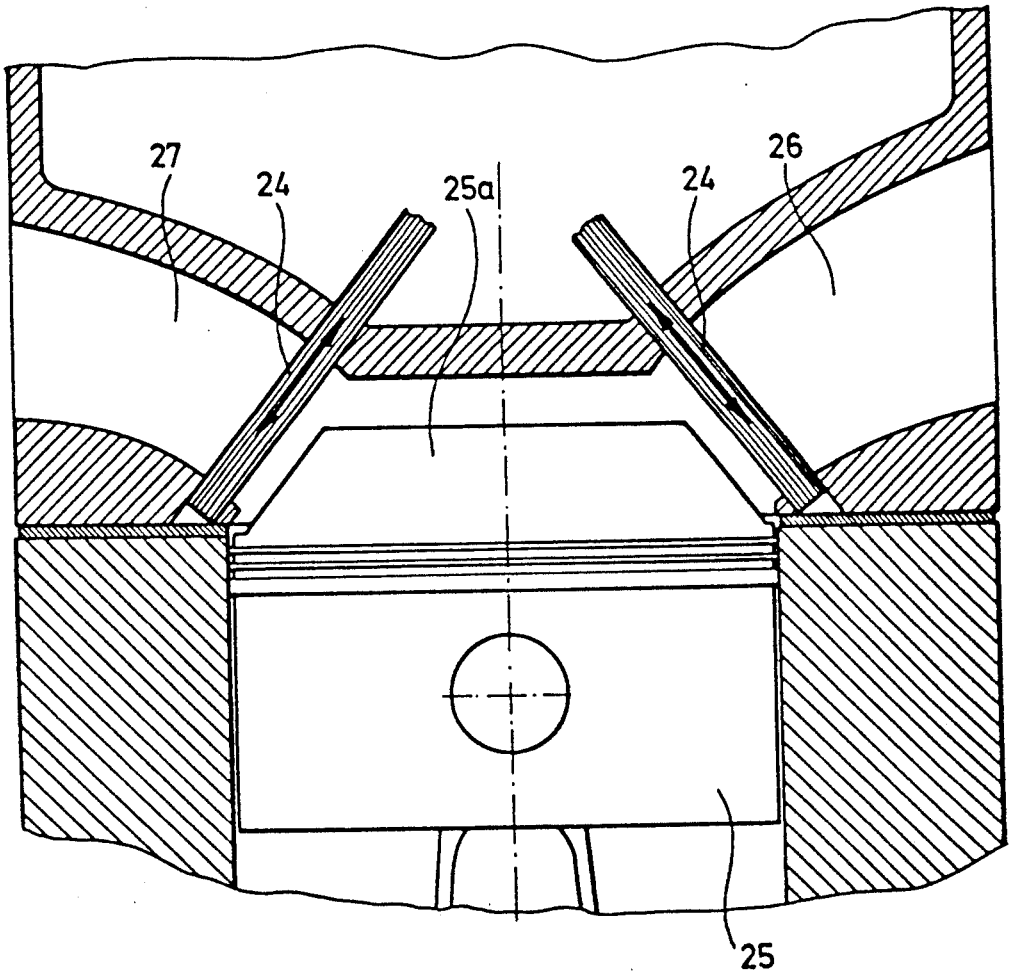
Figure 4A:
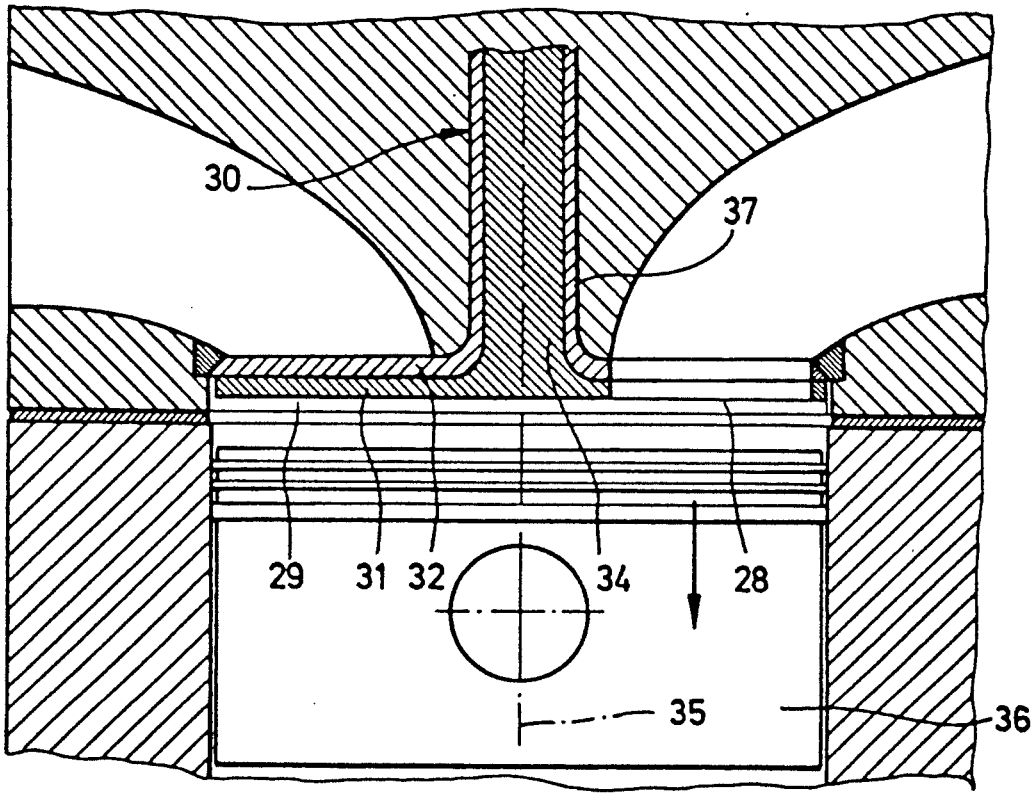
Figure 4B:
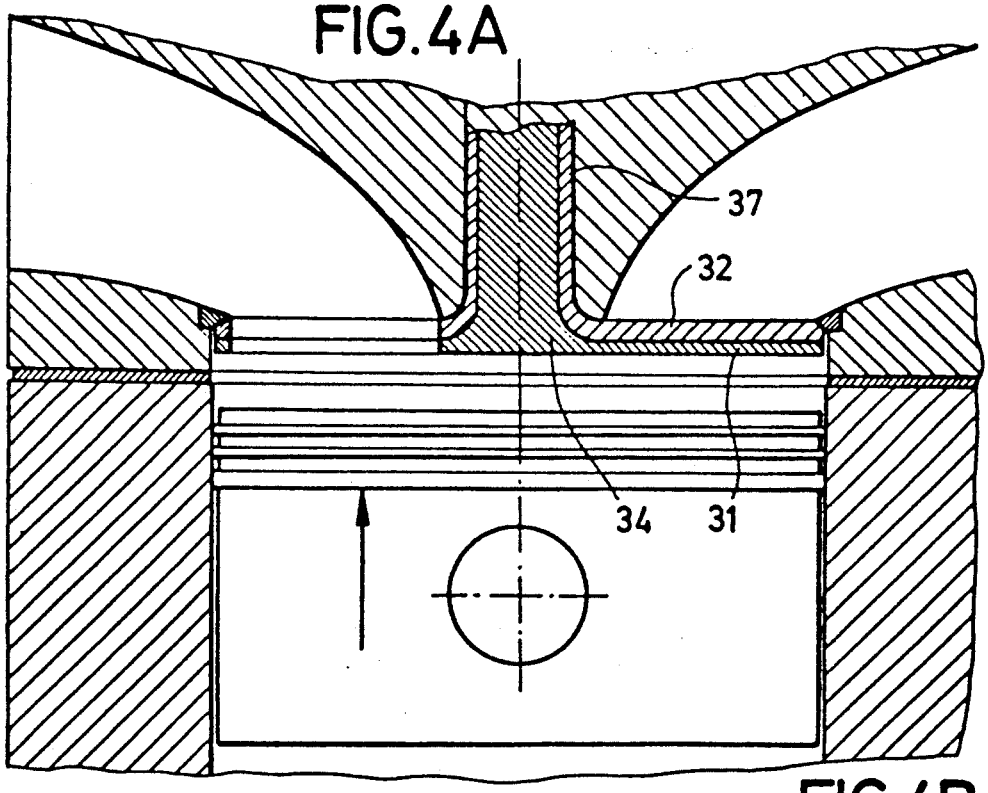
Figure 5:
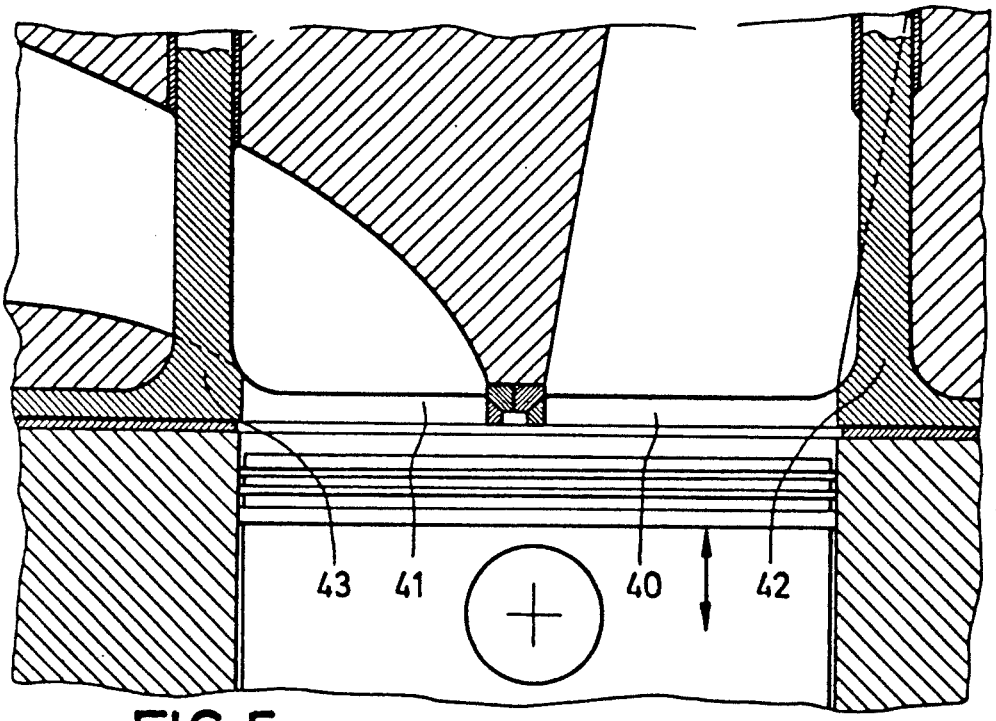
Figure 6:
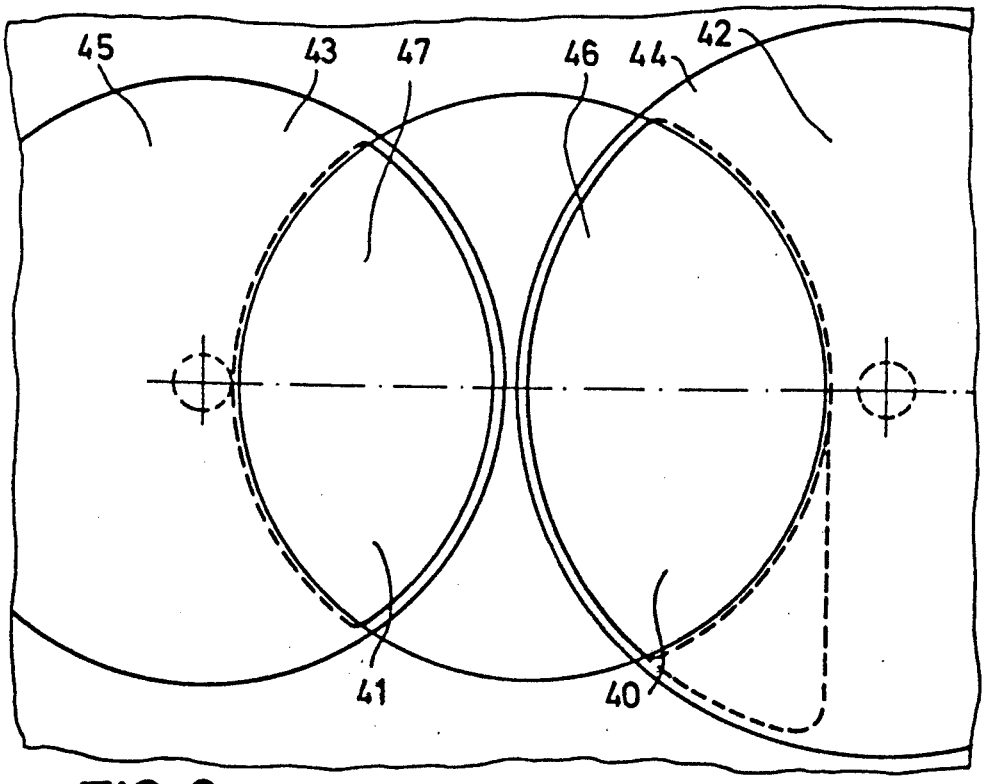
Figure 7:
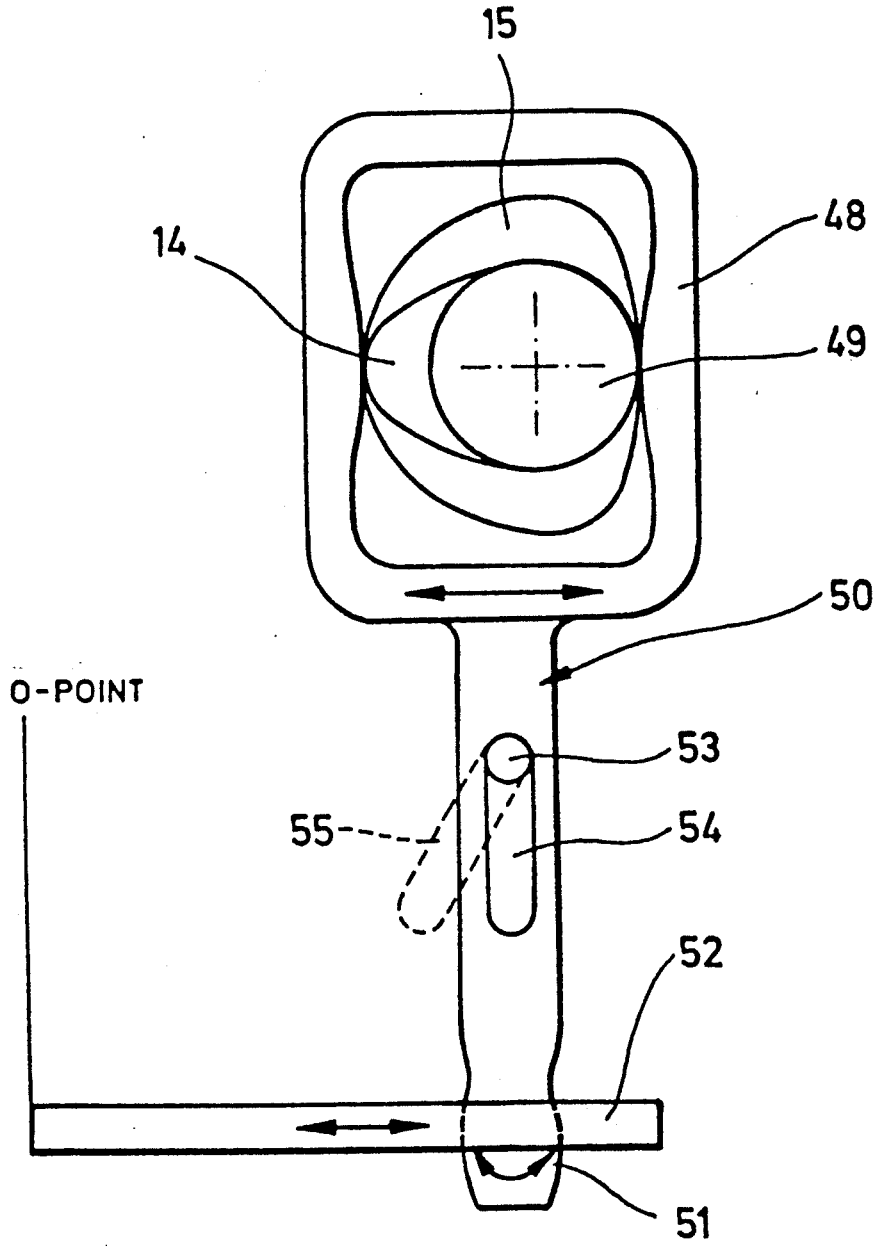
Figure 8A:
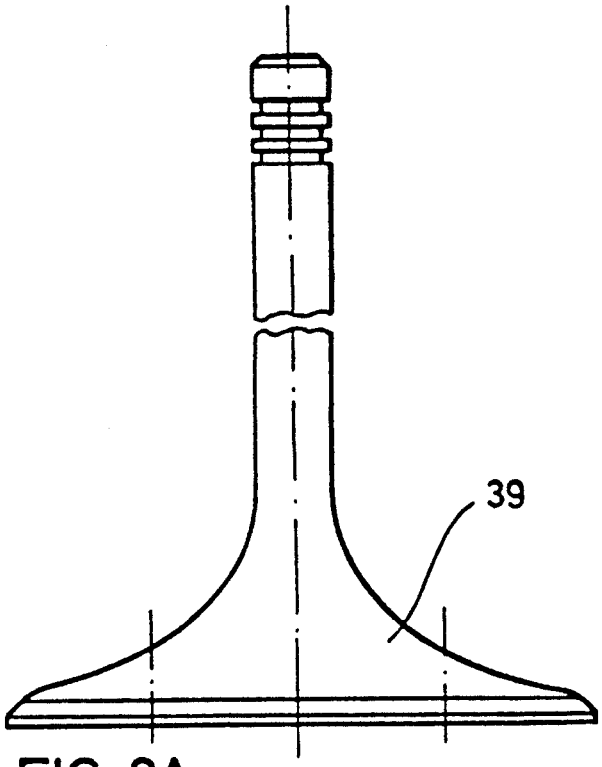
Figure 8B:
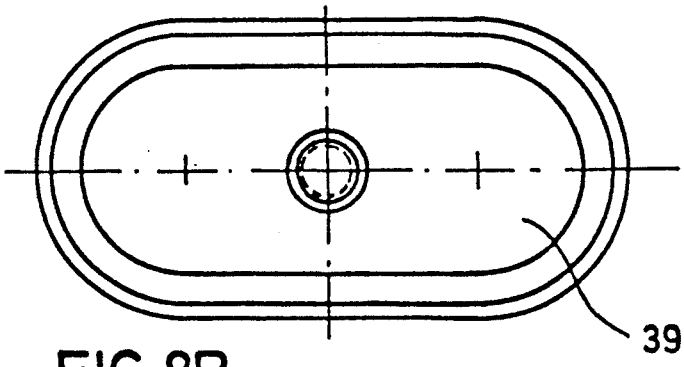
Figure 8C:
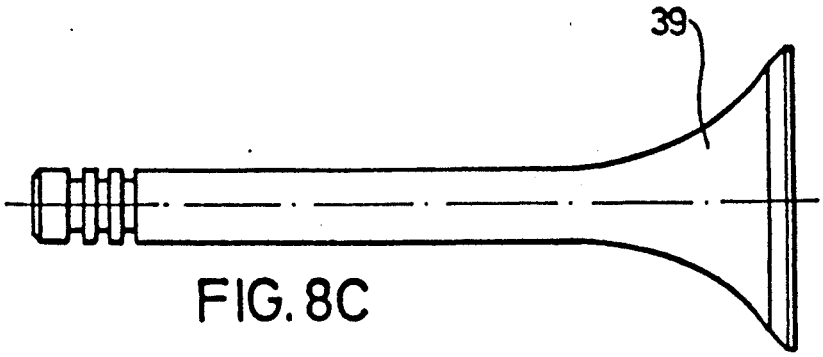

Other features, advantages and details of the invention will become apparent from the following decription of some peferred embodiments and with the aid of the drawings which show in a purely diagrammatic way in:

FIG. 1, a longitudinal section through the area of a cylinder head including flat valve slides, with the actuation members of the left flat slide being omitted;

FIG. 2, a top view on the inlet port and the outlet port of the embodiment of FIG. 1;

FIG. 3, a representation similar to FIG. 1, but with diagonally arranged flat slides whose actuation members are omitted in the figure;

FIGS. 4A and 4B, a representation similar to FIGS. 1 and 3, but with a rotary valve in two different opening positions, without the actuation members of the valve;

FIG. 5, a representation similar to FIG. 4A, but with two independently arranged rotary valves;

FIG. 6, a top view on the inlet and outlet ports of the embodiment of FIG. 5;

FIG. 7, an alternative control of the flat slide of FIG. 1 with an infinitely adjustable lift; and FIGS. 8A to 8C, a valve with two valve disks that are oval in plan view, in two side views and in plan view.

The valve arrangement shown in FIG. 1 comprises a respective flat slide 20 for opening and closing an inlet port 18 and an outlet port 19, the flat slides being adapted to be reciprocated in the direction of arrows 21. For this purpose, the flat slides 20 are drivingly connected at their outer ends to an annular actuation portion 10 which is acted upon by an associated opening cam 14 and a closing cam 15 (or two identical closing cams 15) of a camshaft 16. FIG. 1 shows a piston 22 in the area of its top dead center position with closed inlet and outlet ports 18, 19. As can be seen from FIG. 2, both the inlet port 18 and the outlet port 19 have a substantially semicircular shape and are separated from each other by a center web 23 including recesses 17 into which the flat slides 20 tightly engage in the extended closing position, as shown in FIG. 1. The inlet port 18 has a greater cross-sectional area than the outlet port 19. Moreover, the flat slides 20 are positively guided in continuous slots 11 of the walls 12 of the cylinder head 13, and suitable seals (not shown) can here ensure a gastight sealing.

With the valve arrangement shown in FIG. 3, two valve slides 24 are arranged in a direction oblique to the longitudinal center axis of the piston 25 and can again be reciprocated for opening and closing an inlet port 26 and an outlet port 27. For this purpose an upper camshaft (not shown in the figure) is arranged which, in turn, forcibly reciprocates the two valve slides 24 through annular actuation portions. In this embodiment the head end 25*a* of the piston 25 can be constructed such that it corresponds to the oblique arrangement of the valve slides.

In FIGS. 4A and 4B an inlet port 28, as well as an outlet port 29 are opened and closed in cycles by a rotary valve 30 which comprises two valve disks 31, 32 that are rotatable independently of each other. The lower valve disk 31 is integrally connected to a central shaft 34 which is in alignment with the longitudinal center axis 35 of the piston 36. The hollow shaft 37 which is integrally connected to the valve disk 32 is rotatably seated on the central shaft 34. The shafts 34 and 37 are cyclically rotated independently of each other via suitable drive means in such a way that either the outlet port 29 (FIG. 4A) or the inlet port 28 (FIG. 4B), or both ports are closed. The rotational movements of the valve disks 31 and 32 can be controlled with the aid of a stepping motor in each phase, which is also within the scope of the invention.

In FIGS. 5 and 6 an inlet port 40 and an outlet port 41 are opened and closed in cycles by two rotary valves 42 and 43 which are arranged next to each other and whose valve disks 44 and 45 comprise suitable recesses 46 and 47 for this purpose. The rotary valves 42 and 43 are rotated in cycles and independently of each other via suitable drive means, preferably stepping motors, in such a way that either one of the two ports or both ports are closed.

FIG. 7 shows an alternative control for flat slide valves. An annular actuation portion 48 which is moved in cycles by the opening and closing cams 14, 15 which are seated on a camshaft 49 is connected to a rocker arm 50 which extends with a correspondingly rounded end portion 51 through a hole of the flat slide 52 and is pivotably supported between the end portion 51 and the annular actuation portion on an axle 53. This axle extends through an elongated hole 54 of the rocker arm 50 and is held displaceably and obliquely downwards in obliquely extending elongated holes 55 of the cylinder head, the elongated holes 55 being of such a shape that when the axle 53 is adjusted in the elongated holes, the zero point of the closing lift remains constant so that the inlet port can always be closed tightly. The opening lift can be infinitely varied by adjusting the axle 53, the position of the camshaft 49 remaining constant in contrast to the above-described embodiment of FIG. 1. The adjustment is carried out with a suitable mechanism, e.g. hydraulically, mechanically or by means of an electric motor, the opening lift being reduced in the lower speed range of the engine.

FIGS. 8A to 8C show a valve 39 whose valve disk is oval in plan view so that the valve 39 can replace two circular valves that are arranged next to each other, and nevertheless have a greater valve port. The stem of the valve disk can be connected integrally or, through a connection means, drivingly to an annular actuation portion 10, as shown in FIG. 1, which in conformity with FIG. 1 can encompass an associated opening cam 14 and one or two closing cams 15 of a camshaft 16 for reciprocation in the axial direction of the valve stem. Alternatively, the oval valve can also be reciprocated by one or two rocker arms in the direction of the valve stem.

I claim:

1. A valve arrangement for the cylinders of an internal combustion engine, each cylinder comprising a cylinder head with an inlet port for the fuel mixture and an outlet port, as well as an inlet valve and an outlet valve, the latter being preferably moved by at least one camshaft into the opening or closing position, characterized in that a separate flat slide is respectively arranged as an inlet valve and an outlet valve of a cylinder, each flat slide comprising a closed flat slide surface without through holes, such as slots, and being movable between a retracted opening position and an extended closing position and guided in a gastight way in recesses of the valve head, and that the total surface of said inlet port and said outlet port amounts to 60 to 90% of the inner cross-sectional area of said cylinder.

2. The valve arrangement according to claim 1, characterized in that each of said flat slides is integrally connected at its end projecting laterally from the cylinder head, to an annular actuation portion which encompasses an associated opening cam and at least one, preferably two associated closing cams of said camshaft for reciprocating said flat slide.

3. The valve arrangement according to claim 1, characterized in that said flat slides are movable in a direction substantially perpendicular to the direction of movement of the piston of said cylinder, and that two lateral camshafts are arranged for actuating said flat slides.

4. The valve arrangement according to claim 1, characterized in that the lateral distance between the camshaft assigned to the inlet ports of said cylinders, and said inlet ports is adjustable by means of an adjusting mechanism connected to said camshaft so that the opening degree of said inlet ports is controllable.

5. The valve arrangement according to claim 1, characterized in said flat slides are arranged in a direction oblique or parallel to the direction of movement of said piston.

6. The valve arrangement according to claim 1, characterized in that each flat slide assigned to an inlet port can be moved by a rocker arm which is coupled at one end with said camshaft and at its other end with said flat slide and pivotally supported in an intermediate position on an axle which extends through an elongated hole of said rocker arm and which, moreover, is adjustably held by means of a suitable mechanism in elongated holes of said cylinder head which extend in such an oblique direction that the opening lift of said flat slide is infinitely adjustable, the zero point of the closing lift of said flat slide being always maintained when said axle is adjusted in said elongated holes.

7. The valve arrangement according to claim 1, characterized in that a rocker arm for cyclically moving said flat slide encompasses associated opening and closing cams of said camshaft with an annular portion and extends with a round end portion through a hole of the flat slide end portion projecting laterally from said cylinder head.

8. The valve arrangement according to claim 1, characterized in that both said inlet port and said outlet port of said cylinder have about the shape of a semicircle and are separated from each other by a central web.

* * * * *